US007245115B2

(12) United States Patent
Chilcote

(10) Patent No.: US 7,245,115 B2
(45) Date of Patent: Jul. 17, 2007

(54) LOW DROP OUT VOLTAGE REGULATOR

(75) Inventor: Jason M. Chilcote, Frisco, TX (US)

(73) Assignee: Honeywell International Inc., Morristown, NJ (US)

( * ) Notice: Subject to any disclaimer, the term of this patent is extended or adjusted under 35 U.S.C. 154(b) by 58 days.

(21) Appl. No.: 11/221,467

(22) Filed: Sep. 7, 2005

(65) Prior Publication Data

US 2007/0052400 A1 Mar. 8, 2007

(51) Int. Cl.
*G05F 1/40* (2006.01)

(52) U.S. Cl. ..... 323/282; 323/272

(58) Field of Classification Search ..... 323/280–282, 323/271–277, 312–316; 327/540, 143, 513, 327/541

See application file for complete search history.

(56) References Cited

U.S. PATENT DOCUMENTS

| | | | | |
|---|---|---|---|---|
| 5,563,501 | A * | 10/1996 | Chan | 323/282 |
| 6,188,212 | B1 | 2/2001 | Larson et al. | 323/281 |
| 6,201,375 | B1 | 3/2001 | Larson et al. | 323/277 |
| 6,225,857 | B1 | 5/2001 | Brokaw | 327/540 |
| 6,304,131 | B1 | 10/2001 | Huggins et al. | |
| 6,333,623 | B1 | 12/2001 | Heisley et al. | 323/280 |
| 6,373,233 | B2 | 4/2002 | Bakker et al. | 323/282 |
| 6,465,994 | B1 | 10/2002 | Xi | 323/274 |
| 6,518,737 | B1 | 2/2003 | Stanescu et al. | 323/280 |
| 6,522,114 | B1 | 2/2003 | Bakker et al. | 323/282 |
| 6,541,946 | B1 | 4/2003 | Chen et al. | 323/280 |
| 6,621,675 | B2 | 9/2003 | Ingino, Jr. | 361/91.1 |
| 6,822,514 | B1 * | 11/2004 | Aude | 330/260 |
| 6,914,476 | B2 | 7/2005 | Ingino, Jr. | 327/540 |
| 2003/0111986 | A1 | 6/2003 | Xi | |
| 2004/0046532 | A1 | 3/2004 | Menegoli et al. | 323/273 |
| 2005/0184711 | A1 | 8/2005 | Chen et al. | 323/280 |

FOREIGN PATENT DOCUMENTS

| | | | |
|---|---|---|---|
| WO | WO 96/41248 | A | 12/1996 |

* cited by examiner

*Primary Examiner*—Rajnikant B. Patel
(74) *Attorney, Agent, or Firm*—Kermit D. Lopez; Luis M. Ortiz

(57) ABSTRACT

A low dropout voltage regulator apparatus is disclosed, which includes a low dropout voltage regulator circuit connected to a supply voltage, wherein at least one input voltage is input to the low dropout voltage regulator circuit to generate at least one output voltage from the low dropout voltage regulator circuit. A feedback compensation component is also provided, which is integrated with the low dropout voltage regulator circuit. The feedback compensation component is located generally within the low dropout voltage regulator circuit to take advantage of a Miller effect associated with the low dropout voltage regulator circuit in order to withstand high voltages associated with the supply voltage and generate the output voltage from the low dropout voltage regulator circuit.

18 Claims, 5 Drawing Sheets

LOW DROP OUT VOLTAGE REGULATOR

TECHNICAL FIELD

Embodiments are generally related to voltage regulators. Embodiments also relate to low dropout regulators utilized in electronic industrial and consumer applications.

BACKGROUND

Voltage regulators are utilized in a variety of electrical and electro-mechanical applications. DC voltage regulators, for example, are typically implemented in the context of a static circuit that accepts a variable DC voltage input and produces a regulated DC voltage output. The output voltage is maintained for changes in input voltage and output load current. One type of voltage regulator utilized widely in industrial and commercial applications is the low dropout regulator. The "Low Dropout Regulator" also known as an LDO generally functions with a lower voltage across it before it stops regulating.

FIG. 1 illustrates a schematic diagram or a prior art electrical circuit 10 that functions as a low drop regulator. In general, circuit 10 includes a transistor 14 connected to a supply voltage 12 and a transistor 16. A transistor 18 is generally connected to transistor 16 and also to a current source 20, which is connected to ground and also connected to an output of transistor 14. A transistor 26 is also connected to transistor 14 and to a transistor 24, which in turn is connected to a capacitor 22 disposed between nodes A and B.

Transistor 24 is generally disposed between nodes A and D. A resistor 28 is connected to node D and a node G. A resistor 38 is in turn connected to node G and ground. Transistor 26 is also connected to node G. A resistor 32 is also provided, which is connected to a resistor 30. Note that resistors 30 and 32 are configured in parallel with a capacitor 34 and a resistor 36. A node C is connected to one end of resistor 30 and one end of capacitor 34 and resistor 36. An output voltage 37 can be obtained from node C, which also happens to be connected to transistor 16. One of the problems with prior art circuit 10 is that circuit 10 often requires the use of the external capacitor 34 and is unable to operate at higher supply voltages due to electrical breakdown considerations of capacitor 22. Additionally, circuit 10 requires a large circuit area.

FIG. 2 illustrates a graph 40 depicting data generated from a prior art low drop regulator such as the one depicted in FIG. 1. Graph 40 is provided in the form of a low dropout regulator bode plot in order to demonstrate marginal stability with only 33 degrees of phase margin. An area 42 in graph 40 indicates 33 degrees of stability with little margin thereof. Lines 44 and 46 plotted in graph 40 generally represent loop gain phase shift and magnitude. Graph 40 thus indicates that more than a 180 degree shift with a gain above 0 db is unstable.

One of the primary problems associated with the configuration depicted in FIGS. 1-2 is that circuit 10 does not permit capacitor 22 to withstand a voltage that is a function of $V_{cc}$ or the supply voltage 12. That is, due to the design of circuit 10, capacitor 22 cannot provide optimal compensation. It is therefore believed that an improved low dropout voltage regulator design and implementation is required to overcome the inherent problems associated with the prior art, such as, for example, circuit 10.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved low dropout voltage regulator apparatus.

It is another aspect of the present invention to provide for an improved low dropout voltage regulator apparatus that incorporates the use of a feedback compensation component.

It is a further aspect of the present invention to provide for an improved low dropout voltage regulator apparatus that incorporates the use of a feedback compensation component that takes advantage of the Miller effect for improved compensation thereof.

The aforementioned aspects and other objectives and advantages can now be achieved as described herein. A low dropout voltage regulator apparatus is disclosed, which includes a low dropout voltage regulator circuit connected to a supply voltage, wherein at least one input voltage is input to the low dropout voltage regulator circuit to generate at least one output voltage from the low dropout voltage regulator circuit. A feedback compensation component is also provided, which is integrated with the low dropout voltage regulator circuit. The feedback compensation component is located generally within the low dropout voltage regulator circuit to take advantage of a Miller effect associated with the low dropout voltage regulator circuit in order to withstand high voltages associated with the supply voltage and generate the output voltage from the low dropout voltage regulator circuit.

The feedback compensation component generally comprises a capacitor, such as, for example, a bipolar junction capacitor or a dielectric capacitor. By implementing such a voltage regulator circuit, the supply voltage dependency across the feedback compensation component or capacitor can be eliminated and the required size of the capacitor is reduced. This reduction is a result of the improved utilization of the Miller effect in combination with the voltage remaining constant across the feedback compensation component or capacitor to prevent the effective capacitance lowering at higher voltages. In addition, the input robustness (e.g., maximum supply voltage and ESD immunity) can be improved by not providing a configuration in which the capacitor is coupled to the supply voltage input.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 3:
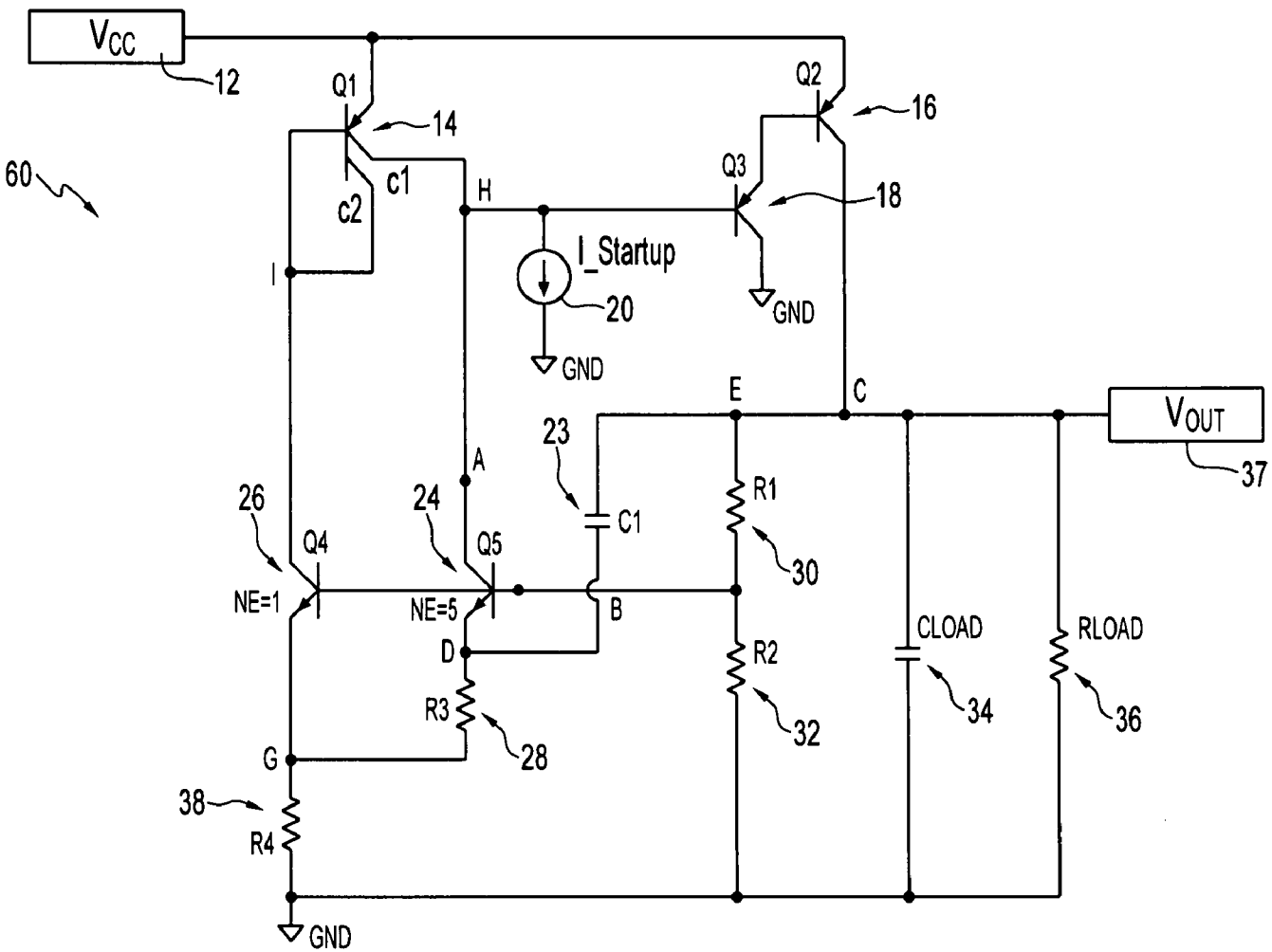
FIG. 3 illustrates a schematic diagram of an electrical circuit that functions as an improved low dropout regulator, in accordance with a preferred embodiment.

FIG. 3 illustrates a schematic diagram of an electrical circuit 60 that functions as an improved low dropout regular, in accordance with a preferred embodiment. Note that in FIGS. 1 and 3, identical or similar parts or elements are generally indicated by identical reference numerals. Despite the use of such elements in, for example FIG. 1, the prior art circuit 10 of FIG. 1 should not be considered a limiting feature of the embodiments, but is instead presented herein for general illustrative and background purposes only and also to describe a context for the improvements achieved by the disclosed embodiments. Circuit 60 generally includes transistor 14, which is connected to a power supply voltage 12 and a transistor 16.

The transistor 16 is in turn connected to a transistor 18, which is connected to ground and to a current supply 20. Note that the current supply 20 is also connected to transistor 14 and can provide a start-up current such as, for example, 15 micro amps, depending of course, upon design considerations. Transistor 14 is generally connected to transistor 18 and current supply 20 at node H. Transistor 14 is further connected to transistor 26 at node I. Transistor 26 is in turn connected to resistor 38 at node G. Transistor 26 is also connected to resistor 28 at node G.

Figure 1:
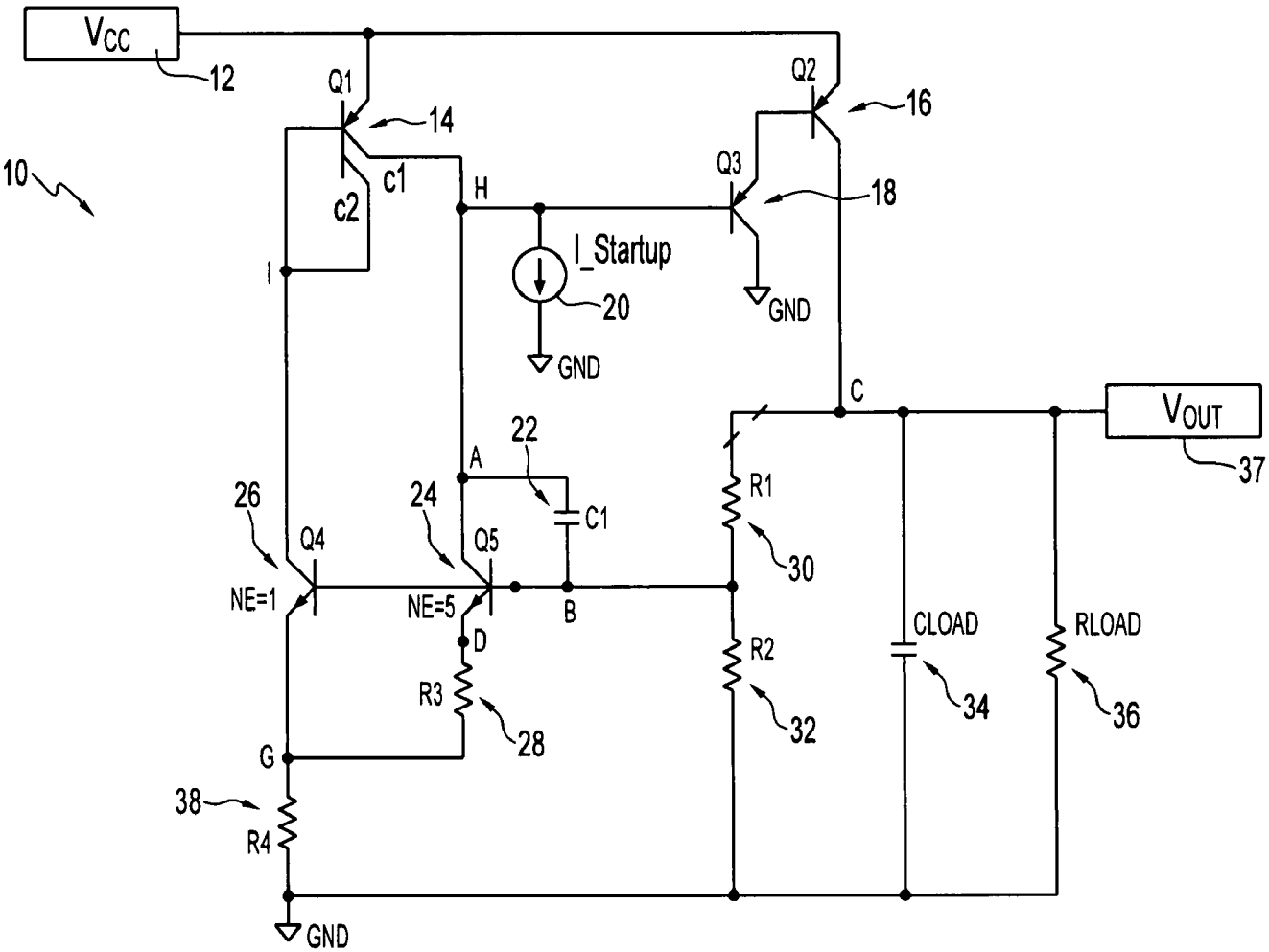
FIG. 1 (PRIOR ART)
FIG. 1 illustrates a schematic diagram or a prior art electrical circuit that functions as a low drop regulator.

Additionally, unlike the prior art configuration depicted in FIG. 1, the circuit 60 illustrated in FIG. 3 includes a capacitor 23 that is disposed between nodes E/C and D. Capacitor 23 is selected to preferably withstand a voltage that is less than the $V_{out}$, the output voltage 37, while providing superior compensation by taking advantage of a larger Miller effect. Note that as utilized herein the term "Miller effect" refers generally to the phenomenon by which an effective feedback path between an input and an output of an electronic device can be provided by the inter-electrode capacitance of the device. This can affect the total input admittance of the device, which may result in the total dynamic input capacitance of the device being always equal to or greater than the sum of the static electrode capacitances. Capacitor 23 therefore functions as a feedback compensation component for circuit 60.

Resistor 28 is in turn generally connected to transistor 24 at node D. Note that transistor 24 is also connected to node A, which electrically constitutes the same node as node H. Transistor 24 is thus connected to transistor 14, current supply 20 and transistor 18 at node A/H. Resistor 28 is also connected to the compensation capacitor 23.

Resistors 30 and 32 form a resistor divider and connect to the base of transistors 24 and 26 at node B. Capacitor 23, resistor 30 and capacitor 34 and resistor 36 are also connected to node E, which is electrically the same node as node C from which a voltage output 37 can be taken. Note that capacitor 34, which may be part of the typical load, is configured in parallel with resistor 36, which functions as the electrical load. The capacitor 34 will generally not be needed due to the improved compensation provided by capacitor 23.

Figure 4:
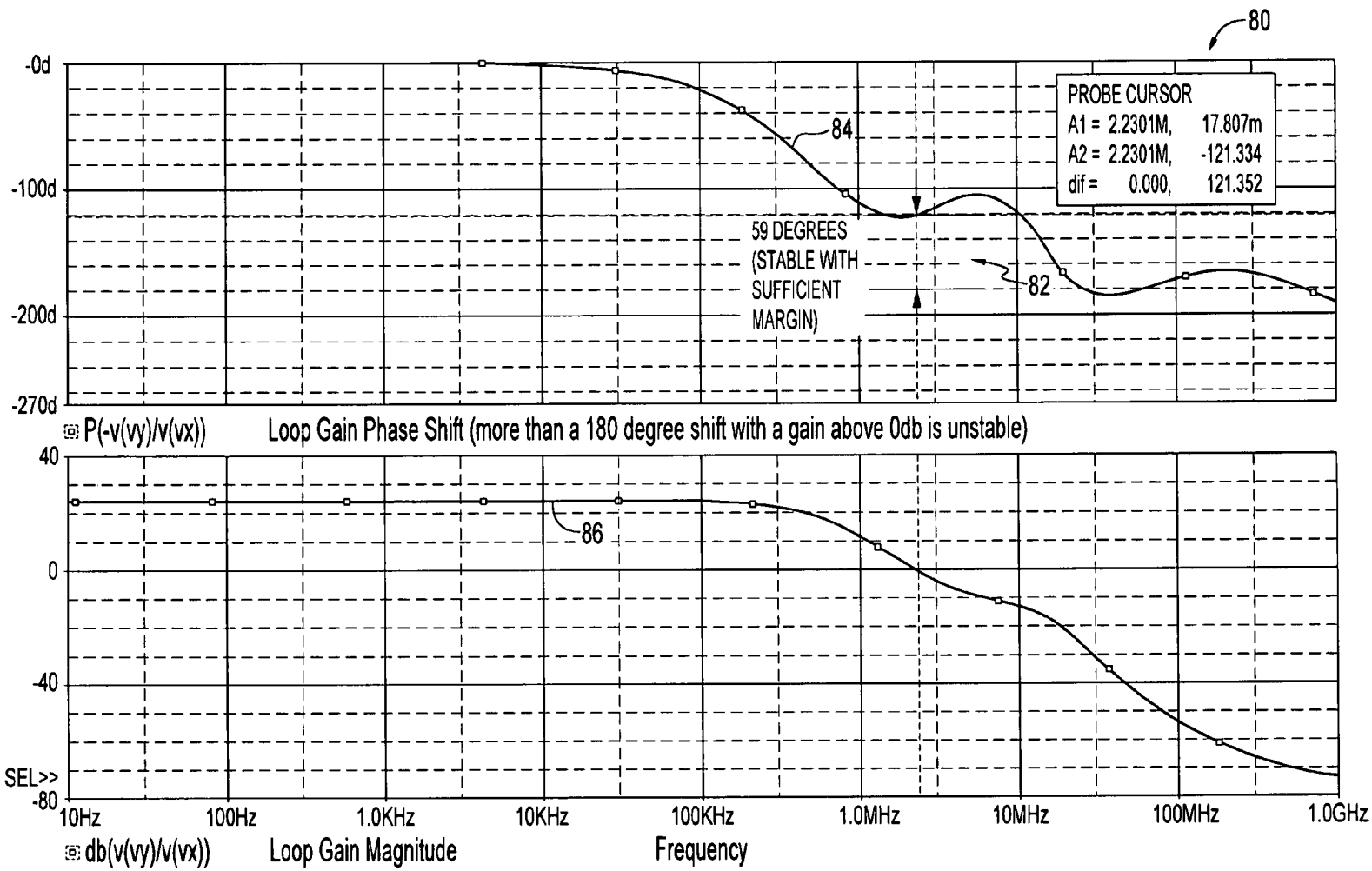
FIG. 4 illustrates a graph depicting data generated from an improved low dropout regulator such as the one depicted in FIG. 3.

FIG. 4 illustrates a graph 80 depicting data generated from an improved low dropout regulator such as that of circuit 60 depicted in FIG. 3. Graph 80 generally describes an improved compensation low dropout bode plot associated with data generated by circuit 60. Graph 80 indicates loop gain magnitude data and loop gain phase shift data. A such, more than a 180 degree shift with a gain above 0 db is unstable, which is a much greater improvement over the data depicted in the prior art graph 40 described earlier. Graph 80 indicates an increased stability with 59 degrees of phase margin, as indicated by area 82, which is disposed beneath line 84 and above −180 degrees where line 86 crosses zero decibels.

Figure 5:
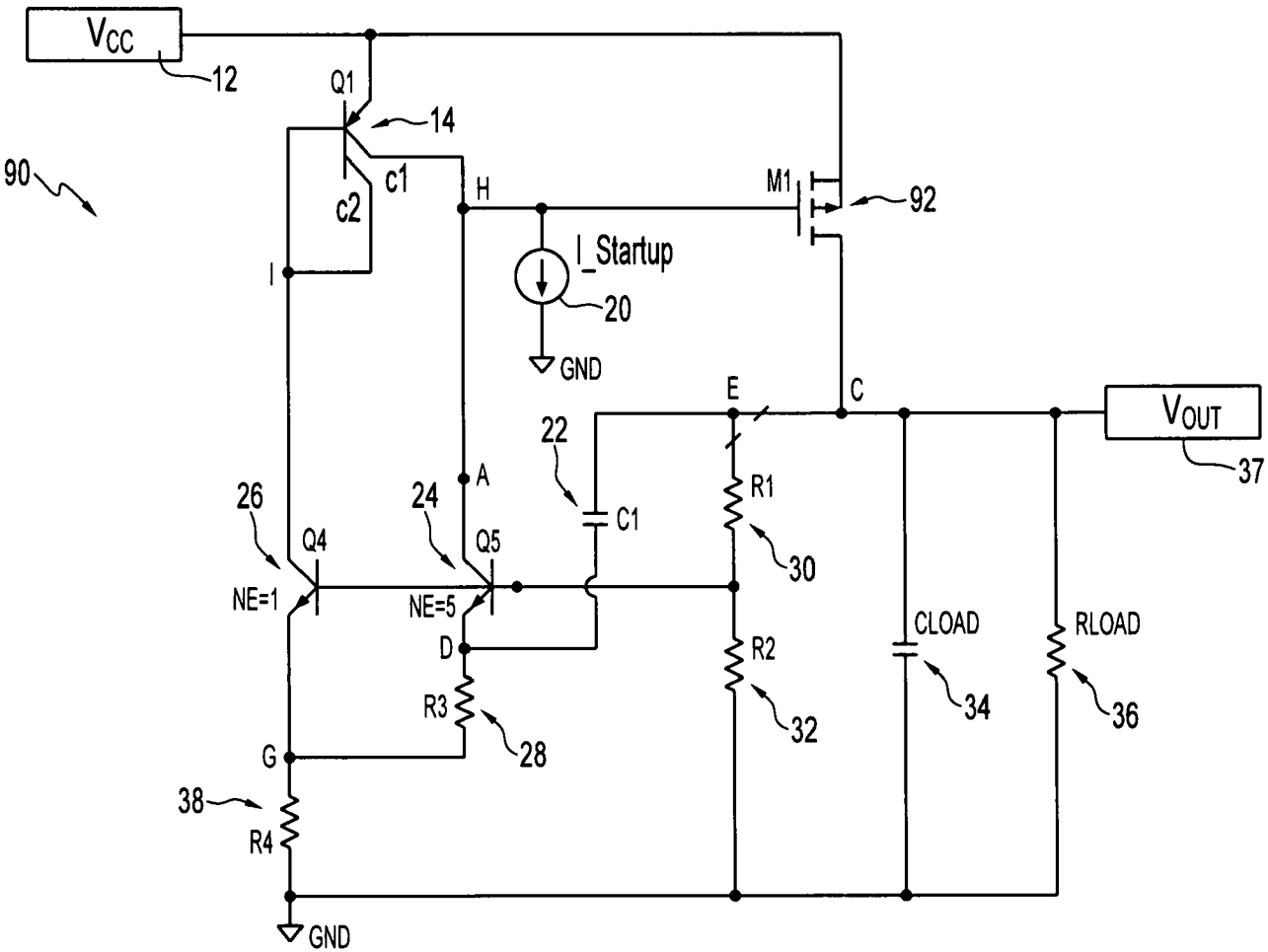
FIG. 5 illustrates a schematic diagram of a compensation low dropout FET circuit that can be implemented in accordance with an alternative embodiment.

FIG. 5 illustrates a schematic diagram of a compensation low dropout FET circuit 90 that can be implemented in accordance with an alternative embodiment. Note that in FIGS. 1, 3, and 5, identical or similar parts or elements are generally indicated by identical reference numerals. Again, despite the use of the same reference numerals in, for example FIG. 1, the prior art circuit 10 of FIG. 1 should not be considered a limiting feature of the embodiments, but is instead presented herein for general illustrative and background purposes only and also to describe a context for the improvements achieved by the disclosed embodiments.

Circuit 90, which functions as a low dropout voltage regulator circuit, generally includes transistor 14 connected to a supply voltage 12, a current source 20 and an FET transistor 92. Additionally, transistor 26 is connected to resistor 38 and resistor 28 at node G. Transistor 26 is also connected to transistor 24, which in turn is connected to resistor 28 at node D. In system or circuit 90 depicted in FIG. 5, capacitor 22 is generally disposed between nodes C and D. In the configuration depicted in FIG. 5, unlike the configuration depicted in FIG. 1, capacitor 22 is selected to preferably withstand a voltage that is less than $V_{out}$ (i.e., voltage output 37) while providing a superior compensation thereof by utilizing a large Miller effect. Capacitor 22 depicted in FIG. 5 thus functions as the feedback compensation component for circuit 90. Capacitor 22 can be provided as, for example, a bipolar junction capacitor or an oxide capacitor. Capacitor 22 is generally disposed between nodes E/C and node D. Node D is located at an emitter of transistor 24. Node D is also connected to resistor 28.

Resistors 30 and 32 are also connected to node B, while a node C is connected to FET transistor 92, resistor 30, capacitor 22, capacitor 34 and resistor 36. Capacitor 34, which may be part of the typical load, is located in parallel with resistor 36, which functions as an electrical load. Resistors 30 and 32 are located in series with one another and in together in parallel with capacitor 34 and resistor 36. The voltage output 37 can be obtained from node C.

Figure 2:
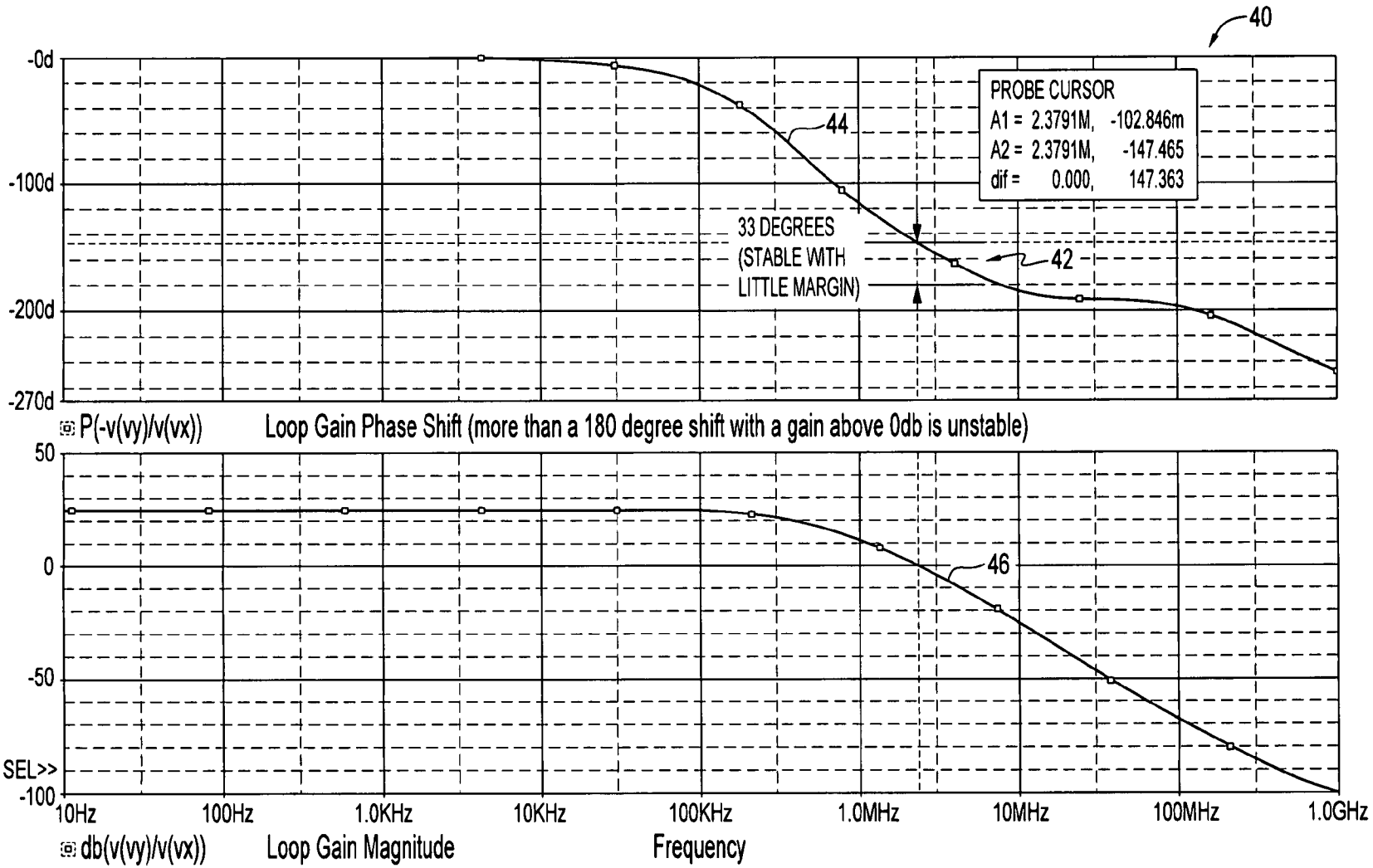
FIG. 2 (PRIOR ART)
FIG. 2 illustrates a graph depicting data generated from a prior art low drop regulator such as the one depicted in FIG. 1.

Circuit 90 thus implements a basic circuit topology in the context of a low dropout regulator that can be configured by altering how the feedback compensation is accomplished. Circuit 90 can be implemented utilizing bipolar technology. The supply voltage dependency across capacitor 22 (e.g., a bipolar junction capacitor) can be eliminated and the required size of capacitor 22 thereby reduced. This reduction is a result of the improved utilization of the Miller effect in combination with the voltage remaining constant across capacitor 22 to prevent the effective capacitance lowering at higher voltages, particularly when junction capacitors are utilized. In addition, the input robustness (i.e., max supply voltage and ESD immunity) is thus improved by not having the capacitor coupled to the supply voltage 12. The same advantages are also associated with circuit 60 depicted in FIG. 3 with respect to the feedback compensation capacitor 23. Such advantages clearly are not available via the prior art configuration depicted in FIGS. 1-2.

Based on the foregoing it can be appreciated that an improved dropout voltage regulator apparatus has disclosed, which includes a low dropout voltage regulator circuit (e.g., circuits 60, 90) connected to a supply voltage 12, wherein at least one input voltage is input to the low dropout voltage regulator circuit 60 or 90 to generate at least one output voltage from the low dropout voltage regulator circuit 60 or 90. A feedback compensation component 22 or 23 can also be provided, which is integrated with the low dropout voltage regulator circuit 60 or 90. The feedback compensation component 22 or 23 is located generally within the low dropout voltage regulator circuit 60 or 90 to take advantage of a Miller effect associated with the low dropout voltage regulator circuit 60 or 90 in order to withstand high voltages associated with the supply voltage 12 and generate the output voltage 37 from the low dropout voltage regulator circuit 60 or 90.

The feedback compensation component 22 or 23 can be implemented as a capacitor, such as, for example, a bipolar junction capacitor or dielectric capacitor. If provided as a dielectric capacitor, for instance, the feedback compensation component 22 and/or 23 can be configured as a dielectric capacitor composed of two metal sheets placed on either side of a layer of dielectric material. Dielectrics are materials like glass or plastics (polymers) which are insulators. The behavior of a dielectric is determined by its dielectric constant value.

By implementing such a voltage regulator circuit 60 or 90, the supply voltage dependency across the feedback compensation component or capacitor 22, 23 can be eliminated and the required size of the capacitor 22, 23 is reduced. This reduction is a result of the improved utilization of the Miller effect in combination with the voltage remaining constant across the feedback compensation component or capacitor 22, 23 to prevent the effective capacitance lowering at higher voltages. In addition, the input robustness (e.g., maximum supply voltage and ESD immunity) can be improved by not providing a configuration in which the capacitor 22 or 23 is coupled to the supply voltage input.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A low dropout voltage regulator apparatus, comprising:

a low dropout voltage regulator circuit connected to a supply voltage, wherein said low drop voltage regulator circuit comprises a first transistor connected to an FET transistor and a current source and a first resistor connected to a second resistor and said capacitor, wherein said capacitor is connected to a second transistor, which in turn is connected to a third resistor and a third transistor, wherein said third transistor is connected to a fourth resistor and said first transistor and wherein said fourth resistor is connected to a ground, wherein at least one input voltage is input to said low dropout voltage regulator circuit to generate at least one output voltage from said low dropout voltage regulator circuit; and a feedback compensation component comprising a capacitor, wherein said feedback compensation component is integrated with said low dropout voltage regulator circuit, wherein said feedback compensation component is located within said low dropout voltage regulator circuit to take advantage of a Miller effect associated with said low dropout voltage regulator circuit in order to withstand high voltages associated with said supply voltage and generate said at least one output voltage from said low dropout voltage regulator circuit.

2. The apparatus of claim 1 wherein said capacitor comprises a bipolar junction capacitor.

3. The apparatus of claim 1 wherein said capacitor comprises a dielectric capacitor.

4. The apparatus of claim 1 wherein said first and second resistors are connected to one another in series and in parallel with a load capacitor and a load resistor.

5. The apparatus of claim 1 wherein said current source generates a startup current and wherein said current source is further connected to said ground.

6. The apparatus of claim 4 wherein said at least one output voltage is provided at a node connected to said FET transistor, said first resistor, said load capacitor and said load resistor.

7. The apparatus of claim 1 wherein said at least one output voltage is provided at a node connected to a load capacitor in parallel with a load resistor associated with said law dropout voltage regulator circuit.

8. A low dropout voltage regulator apparatus, comprising:

a low dropout voltage regulator circuit connected to a supply voltage, wherein at least one input voltage is input to said low dropout voltage regulator circuit to generate at least one output voltage from said low dropout voltage regulator circuit;

a feedback compensation component integrated with said low dropout voltage regulator circuit, wherein said feedback compensation component is located within said low dropout voltage regulator circuit to take advantage of a Miller effect associated with said low dropout voltage regulator circuit in order to withstand high voltages associated with said supply voltage and generate said at least one output voltage from said low dropout voltage regulator circuit, and wherein said feedback compensation component is connected from an emitter of a feedback transistor to a node from which said at least one output voltage is present, and wherein said node is further connected to a load comprising a load capacitor or a load resistor, wherein said load capacitor or said load resistor are connected between a ground and said node from which said as least one output voltage is present.

9. A low dropout voltage regulator apparatus, comprising:

a low dropout voltage regulator circuit connected to a supply voltage, wherein at least one input voltage is input to said low dropout voltage regulator circuit to generate at least one output voltage from said low dropout voltage regulator circuit; and a feedback compensation component integrated with said low dropout voltage regulator circuit, wherein said feedback compensation component is located within said low dropout voltage regulator circuit to take advantage of a Miller effect associated with said low dropout voltage regulator circuit in order to withstand high voltages associated with said supply voltage and generate said at least one output voltage from said low dropout voltage regulator circuit, and wherein said feedback compensation component is connected from an emitter of a feedback transistor to a node from which said at least one output voltage is present, and wherein said node is further connected to a load comprising a load capacitor in parallel with a load resistor, wherein said load capacitor and said load resistor are connected between a ground and said node from which said as least one output voltage is present.

10. The apparatus of claim 9 wherein said feedback compensation component comprises a capacitor.

11. The apparatus of claim 10 wherein said capacitor comprises a bipolar junction capacitor.

12. The apparatus of claim 10 wherein said capacitor comprises a dielectric capacitor.

13. The apparatus of claim 11 wherein said low dropout voltage regulator circuit further comprises a first transistor connected to an FET transistor and a current source;

a first resistor connected to a second resistor and said capacitor, wherein said capacitor is connected to a second transistor, which in turn is connected to a third resistor and a third transistor, wherein said third transistor is connected to a fourth resistor and said first transistor and wherein said fourth resistor is connected to a ground.

14. The apparatus of claim 13 wherein said first and second resistors are connected to one another in series and in parallel with a load capacitor and a load resistor.

15. The apparatus of claim 13 wherein said current source generates a startup current and wherein said current source is further connected to said ground.

16. The apparatus of claim 14 wherein said at least one output voltage is provided at a node connected to said FET transistor, said first resistor, said load capacitor and said load resistor.

17. The apparatus of claim 13 wherein said first and second resistors are connected to one another in series and In parallel with a load capacitor and a load resistor and wherein said current source generates a startup current and wherein said current source is further connected to said ground.

18. The apparatus of claim 13 wherein said current source generates a startup current and wherein said current source is further connected to said ground and wherein said at least one output voltage is provided at a node connected to said FET transistor, said first resistor, said load capacitor and said load resistor.

* * * * *

UNITED STATES PATENT AND TRADEMARK OFFICE

CERTIFICATE OF CORRECTION

PATENT NO. : 7,245,115 B2
APPLICATION NO. : 11/221467
DATED : July 17, 2007
INVENTOR(S) : Jason M. Chilcote It is certified that error appears in the above-identified patent and that said Letters Patent is hereby corrected as shown below:

In Column 6, line 32, delete “law” and add --low--;
In Column 7, line 10, delete “as” and add --at--.

Signed and Sealed this

Thirtieth Day of October, 2007

JON W. DUDAS
*Director of the United States Patent and Trademark Office*